United States Patent [19]

Biebuyck et al.

[11] Patent Number: 4,773,193

[45] Date of Patent: Sep. 27, 1988

[54] FLEXIBLE JOINT BUILDING SYSTEM

[75] Inventors: Lawrence Biebuyck, Dallas; William W. Watson, Rockwall, both of Tex.

[73] Assignee: Butler Manufacturing Company, Kansas City, Mo.

[21] Appl. No.: 865,804

[22] Filed: May 22, 1986

[51] Int. Cl.[4] ..... E04B 7/02

[52] U.S. Cl. ..... 52/93; 52/573; 52/645

[58] Field of Search ..... 52/93, 71, 209, 573, 52/640, 641, 645

[56] References Cited

U.S. PATENT DOCUMENTS

| | | | |
|---|---|---|---|
| 3,313,070 | 4/1967 | Elofson | 52/93 |
| 3,774,356 | 11/1973 | Philp | 52/93 X |
| 3,785,108 | 1/1974 | Satchell | 52/640 X |
| 3,812,638 | 5/1974 | Lerch et al. | 52/93 X |
| 3,844,087 | 10/1974 | Schultz et al. | 52/209 X |
| 3,858,375 | 1/1975 | Silvernail | 52/209 X |
| 4,276,729 | 7/1981 | Shiga et al. | 52/209 |

*Primary Examiner*—Carl D. Friedman

*Attorney, Agent, or Firm*—Thomas L. Cantrell; Stanley R. Moore

[57] ABSTRACT

A dynamic eave building system comprising a flexible joint for first vertical and second angulated structural members pivotally connected one to the other. The adjacent ends of the first and second structural members are mitered into a mating configuration and spaced one from the other by the pivot joint. The pivot joint comprises a pivot pin received through aligned apertures formed in one of the members and in a knee splice secured in the other. The knee splice is positioned to define the flexing space between the mitered ends. The second angulated member also includes moisture collection troughs formed longitudinally therealong. The first member is provided in a hollow configuration for receiving fluid flow from the troughs of the second angulated member. Both members are adapted for securement of conventional curtain wall material, siding or roofing thereon. In this manner, loads on the second angulated member is transferred directly to the first vertical member through the pivot joint and any flexing therein is accommodated by the space between mitered edges.

15 Claims, 3 Drawing Sheets

FLEXIBLE JOINT BUILDING SYSTEM

BACKGROUND OF THE INVENTION

1. Field of the Invention

The present invention pertains to building systems and, more particularly, to a flexible building joint, providing a dynamic eave assembly for the structural intersection of angulated building members.

2. History of the Prior Art

The prior art is replete with structural building techniques which date back into technological antiquity. These structural systems generally incorporate a plurality of vertical, load bearing members, or wall sections, adapted for supporting siding disposed outwardly thereof and roof members thereabove. The support of a roof section necessitates the structural interengagement between the load bearing roof members, such as rafters and the wall members to comprise an eave. In many instances the structural roof members are angulated relative to the wall members for providing a slope to the roof surface facilitating the elimination of water from rain, snow and the like. Such designs are most typically seen in residential construction where pitched roofs have been commonplace for centuries. More conventional commercial construction has also adopted the "pitched roof" look in certain designs. Moreover, many commercial architectural innovations necessitate the utilization of angulated members for sloped side wall regions of buildings as well as roof sections thereon. The reasons vary but are basically founded upon the desire for distinction in both size and shape.

The introduction of angulated side and roof regions in commercial buildings has imposed additional structural and functional considerations. Conventional commercial construction generally utilizes a curtain wall system comprised of a plurality of planar glass sheets mounted upon vertical and horizontal mullions of generally hollow construction. The mullions are secured at various points to the structural members of the building and carry the weight of the glass panels disposed thereon as well as the responsibility for adequate sealing against water intrusion, drainage and structural integrity. Problems with the utilization of hollow mullions in angulated construction are, however, multifold. One problem is water intrusion, sealing and drainage. Another is purely structural, but even more serious. For example, the hollow mullions are fabricated from metal such as aluminum which is much more rigid than the wood which has been used for centuries in angulated roof/wall intersections. Loading of the roof from weight, rain, snow and the like will cause the angled roof members to deflect downwardly causing movement within the intersection. When the wall and roof members are mitered for mating engagement one to the other such deflection loads will cause high levels of compression across the inside edges of the contiguous mitered surfaces and separation forces across the outside mating region. The roof member in essence "pivots" against the vertical member. The inherent softness of wood generally used in residential construction absorbs this deflection load without serious damage to the joint. This is not the case when rigid metal sections are utilized because of the inherent structural rigidity and lack of elasticity to such compression loading. A welded mitered joint can, for example, ultimately manifest cracks along the weld due to the bending moment created through the rigid interengagement therebetween. The inside surfaces of the mitered joint resisting the deflection load serves as a pivot point, or fulcrum, across which the bending forces are amplified toward the outside intersection.

The stress problems of angular intersections have been addressed with gusset plates. The plates are usually conformed to the angle of the intersection and then bolted, welded, or riveted to the structural members. Although gusset plates have found widespread utility, they are both expensive and often unsightly. This has not been a favorite mode of expression because it can appear more like a riveter's handiwork than an architect's innovative design. Conventional attempts have thus been made to make the structural intersection joint not only practical but better looking than the present mode of expression. Current designs thus include a curved profile utilizing either clear plexiglass or a radius tempered insulated glass. The problem with plexiglass is that it is not scratch resistant, is difficult to maintain and often must be replaced within a short period of time due to wear. The radius tempered glass whether of the insulated or noninsulated variety is far more permanent, but is extremely expensive. This creates numerous sealing, handling and installation problems.

Appearance, construction ease and economics are typically the strong considerations in conventional construction of the curtain wall variety. For this reason it would be beneficial to provide a flexible joint structure which does not produce the deleterious bending forces of conventional designs and can facilitate water drainage. The method and apparatus of the present invention provides such an improvement over the prior art through a dynamic eave construction. The assembly utilizes a flexible joint across which a gap is provided preventing the abutting engagement of the inside surfaces of the angulated structural members during loading. Drainage ears on the upper rafter empty water behind the sealant and into the vertical mullion. In one embodiment a pivot pin is included within the joint for transmitting the structural load directly from the roof member to the vertical mullion and facilitating the pivotal interaction therebetween in a manner not detrimental to the structural integrity of the joint. Moreover, the flexible joint can be provided in an aesthetically pleasing configuration without the appearance of gusset plates, welds and the like.

SUMMARY OF THE INVENTION

The present invention pertains to a dynamic eave assembly and method of manufacture of the type facilitating a flexible structural interengagement between angulated building members. More particularly, one aspect of the invention comprises a flexible structural joint comprising first and second mullions adapted for generally angulated positioning relative one to the other. The first and second mullions intersect one another in an angulated relationship across a notional plane defined therebetween. Means are provided for coupling the first and second mullions one to the other in a pivotal relationship. Means are also provided for defining and maintaining a space along the notional plane of intersection between the first and second mullions to facilitate relative movement therebetween and flexibility of the mullions one to the other. The means coupling the first and second mullions comprise a pivot pin secured to one of the mullions and means associated with the other mullion for engaging the pin and affording pivotal movement.

In another aspect, the invention includes the structural joint as set forth above wherein the first mullion further includes a pivot arm secured therein having a journal formed therethrough and adapted for receipt of the pin therein. The second mullion includes a knee splice secured therein, the knee splice has apertures formed through the side walls thereof adapted for receiving the pin therethrough for facilitating pivotal motion about the journal. The knee splice can comprise a hollow channel having oppositely disposed apertures formed therethrough in axial alignment with the journal therein and means for securing the knee splice to the second mullion. The knee splice is further constructed with an angular end face adapted for receipt in and positioned adjacent the inside of the first hollow mullion. The means coupling the first and second mullions further includes first and second apertures formed in the the second mullion. The knee splice has first and second apertures formed therein adapted for registration with the apertures of the vertical mullion for the receipt of the pin therethrough and the pivotal action of the mullions therearound.

In another aspect, the invention includes the structural joint as set forth above wherein the second mullion is constructed with at least one drainage channel formed outwardly therealong. The drainage channel terminates along the notional plane of intersection between the first and second mullions and is adapted for discharging water therefrom into the first mullion. The structural joint further includes means disposed in a lower region of the first mullion adapted for sealably retaining water received from the second mullion and means disposed adjacent the sealing means for discharging the water received therein.

In another aspect, the invention includes an improved structural joint for the mitered intersection between vertical structural members and rafters coupled thereto of the type wherein the rafter is secured to the vertical member across an angulated intersection defining a notional plane of intersection therebetween. The improvement comprises means securing the rafter to the vertical member permitting pivotal movement therebetween. Means are provided for maintaining a spaced relationship across the notional plane of intersection between the vertical member and the rafter for allowing flexibility and relative movement therebetween. The spacer means of the structural joint comprises a pivot pin extending through one of the members and journal means secured to the other of the members adapted for receiving the pin therein and facilitating the the movement therearound. In this manner, loading of the rafter imparts a deflection thereto which is accommodated by movement about the pin. In one embodiment, the vertical structural member and rafter each comprise a hollow mullion adapted for intersecting one another in angulated relationship across the notional plane defined therebetween and the securement of glass panes thereto.

In yet another embodiment, a dynamic eave assembly is provided for coupling structural members in an angulated relationship one to the other and allowing flexibility therebetween for dynamic and static loading thereupon. The structure comprising means associated with the angulated members facilitating pivotal interaction therebetween and means for establishing a notional plane of intersection between the angulated members and a predefined space therebetween. The space accommodates the pivotal action during dynamic loading of the eave. The assembly further includes an elastomeric member disposed along the notional plane of intersection between the angulated members for filling the predefined space therebetween and accommodating relative movement therealong.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
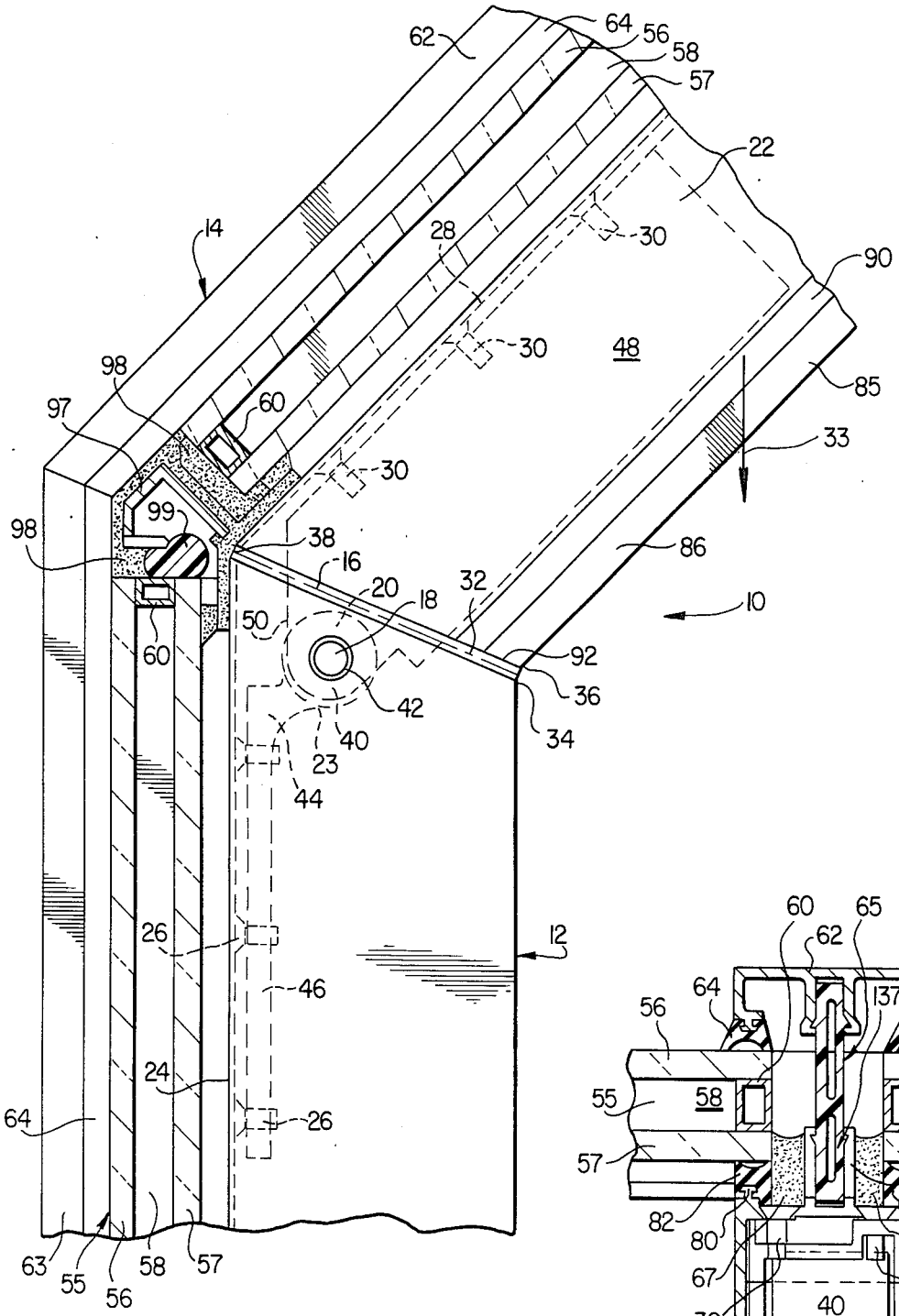
FIG. 1 is a side-elevational, cross-sectional view of the flexible joint of the present invention illustrating the interengagement of angulated structural members in accordance with the principles of the present invention.

Referring first to FIG. 1 there is shown a side-elevational, cross-sectional view of one embodiment of a dynamic eave, or flexible joint 10 constructed in accordance with the principles of the present invention. The flexible joint 10 is comprised of a generally vertical hollow mullion 12 and upper angulated mullion in the form of rafter 14 meeting one another across a notional plane of intersection 16. The members 12 and 14 are pivotally coupled one to the other in structural interengagement by a pin 18. The pin 18 is secured to lower member 12 through pivot arm 20 and to upper member 14 through knee splice, or pivot channel 22. The knee splice 22 is constructed with a curved nose 23 adjacent the pin 18 to eliminate engagement with the vertical member 12. This further facilitates use of a single size of channel 22 for a variety of interaction.

Still referring to FIG. 1, the lower pivot arm 20 is secure to the lower mullion 12 by attachment to the outer wall 24 with a plurality of threaded fasteners 26. The upper knee splice 22 is secured to outer wall 28 of rafter 14 by threaded fasteners extending therethrough. It should be noted that any conventional fastener would be appropriate. In this manner, a predefined gap, or space 32 is presented along the notional plane of intersection 16. Relative movement between rafter 14 and vertical mullion 12 is thus accommodated without the stresses normally associated therewith including the degeneration of structural integrity of the joint itself.

Referring still to FIG. 1, it may be seen that the gap 32 along the notional plane of intersection 16 separates the upper inside edge 34 of lower member 12 from the lower inside edge 36 of upper member 14. In this manner, loading of rafter 14 by dead loads, wind load, or the like which normally cause downward deflection in the direction of arrow 33 will not result in immediate engagement of edges 34 and 36 and the resultant stress amplification across the joint which leads to structural deterioration. In conventional eave construction, load deflection of rafter 14 will result in direct abutment of the inside mitered edges of the structural members. The abutting edges will resist the load and therein manifest a degree of compression and the resulting amplification of separation forces along the notional plane of intersection 16. The forces of separation which are outside point 38 are, in fact, amplified by the length of the notional plane of intersection in conventional assemblies. For this reason, gusset plates and similar reinforcing provisions are generally considered.

In the present invention, gap 32 generated by the securement of knee splice 22 and pivot arm 20 with pin 18 eliminates this serious problem of stress amplification. The pivot arm 20 is constructed with an upper pivot arm journal 40 having an aperture 42 formed therethrough, and structurally connected to the hollow mullion 12 by neck region 44 and depending body section 46. The upper knee splice 22 of the present embodiment is comprised of a metal channel section 48 having an angular end face 50, which is particularly cut for the predefined mitered angle of notional intersection between upper and lower members 14 and 12. Although other structural configurations may be provided for the pivotal interaction between roof and wall members, the assembly of FIG. 1 is particularly adapted for hollow mullions of the type typically used for commercial building construction.

Commercial structures are generally designed for maximum ease in assembly and minimum maintenance. For this reason, a myriad of "curtain wall" designs have been developed throughout the prior art whereby sheets of glass are secured to and sealed in hollow mullions generally constructed with extruded aluminum. The present invention is particularly adapted for the utilization of hollow mullion construction and the problems associated with angular roof members adapted for structural engagement with vertical members. As set forth above, such eave designs are conventional in residential construction utilizing wood which is not as susceptible to the stress amplification leading to structural failure through a mitered intersection. The fibrous nature of wood is readily compressible compared to metal. For this reason the engagement of inside mitered edges of rafters and studs will not create the same degree of load amplification or structural degeneration through the pivotal interaction typified in aluminum construction. Degeneration of a mitered joint can cause lack of structural integrity in the framework of a building system. Sealing failure may also occur, said failure being manifested by water intrusion from rain, snow and the like.

As deleterious as rainwater intrusion is, it is not nearly as catastrophic as a structural or load failure. Recent interest in commercial building designs utilizing a myriad of angular wall sections lending aesthetic beauty to the exterior of the building has lead to concern over the eave design. The very size of commercial buildings itself provides a plurality of structural considerations. These considerations are not generally addressed in residential structures with angular roof sections made of "softer" wood. The rigidity of the metal surfaces of the hollow mullions in mitered joints must however, be addressed because more conventional building designs have emphasized the elimination of the unpleasant appearance of gusset plates. A smooth joint is one design criteria and one which is the genesis of numerous problems. The perfectly mitered intersection of structurally rigid members must meet unconventional stress and strength of material considerations. As stated above, the vertical "dead" load is not the maximum stress to be found across the notional intersection plane 16. The effective creation of a fulcrum, or pivot point, between inside edges of a mitered joint create a leveraging and amplification of loads. Since relative movement and preselected degrees of elasticity are integral elements of architectural designs in commercial structures, the utilization of a dynamic eave such as the flexible pin joint 10 of FIG. 1 is inherently compatible with optimal design goals for structural integrity. The "dynamic" aspect of the eave as used herein refers to the relative movement allowed between members 12 and 14 as compared to the "static" framework of the conventional "mitered joint".

Figure 2:
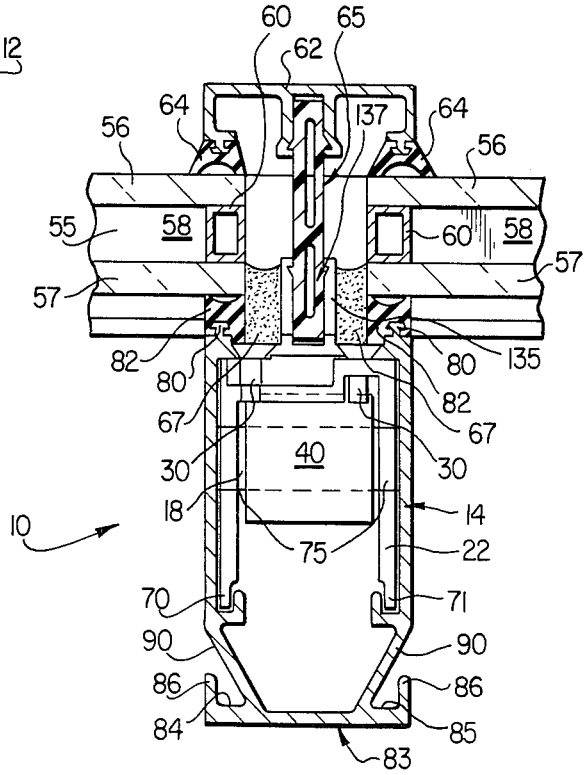
FIG. 2 is a top plan, cross-sectional view of the assembly of FIG. 1 taken along lines 2—2 thereof and illustrating one embodiment of the pivot assembly of the present invention.

Referring now to FIG. 2, there is shown a top plan, cross-sectional view of the rafter 14 and the glass pane assembly 55 mounted therein. The glass pane assembly 55 is comprised of an outer glass sheet 56 and inner glass sheet 57, which forms a dead air space 58 therebetween. The dead air space is sealed at opposite ends by a spacer 60. The pane 55 is secured to the rafter 14 by an outer rafter cap 62, which engages the outer glass panes 56 through glazing rod members 64. The ends of the rafter caps 62 are also mitered for abutting aesthetic engagement. Members 64 provide weather tight seals against the glass surfaces, and are secured thereagainst by internal pin assembly 65. Pin assembly 65 is secured to the rafter cap 62 and to the internal mullion structure, as defined below. Because of the manner of installation, no "leveraged" stresses are imposed thereby. Appropriate sealant 67 is likewise injected into the mullion for preventing water intrusion, as is convention in curtain wall designs.

Still referring to FIG. 2, there is shown the structural assembly of the flexible joint 10 of FIG. 1 from a top plan view. The rafter 14 is shown to be constructed in this particular embodiment with a pair of internal flanges 70 and 71 adapted for receipt of knee splice 22. The knee splice 22 is a generally U-shaped member adapted for securement to rafter 14 by fasteners 30 as set forth in FIG. 1. Pivot arm journal 40 is shown therebeneath in receipt of pivot pin 18, therethrough. Pin 18 extends through the central aperture 42 of pivot arm journal 40 and into apertures 75 forming the side walls of the knee splice 22. In this manner, the knee splice 22 secures the rafter 14 while allowing pivotal action across the pin 18 through the pivot arm 20. The pin may be a ½" diameter rod, or the like, with the knee splice formed of aluminum.

Referring still to FIG. 2, there is shown one embodiment of the cross-sectional construction of the rafter 14. As set forth above water intrusion is a major design aspect and in even more critical with angulated roof sections. The rafter 14 is thus constructed for affording improved water collection and drainage capacity. A pair of upper gasket elements 80 are provided for engaging inside gaskets 82 bearing against inside glass panes 57. The lower end 83 of rafter 14 is formed with a pair of oppositely disposed drainage ears, or channels 84 and 85, each having an upstanding outer flange 86. The drainage channels 84 and 85 are provided for collecting and vectoring any condensed or intruded water along the rafter 14 into the adjoining vertical wall mullion 12. In describing the channeling of said water, attention is directed back to FIG. 1, where flange 86 of channel 85 may be seen. The channels 84 and 85 each include an inside angulated wall portion 90 of rafter 14, which is most clearly seen in FIG. 1. The angulated wall portion 90 provides the indentation region for the formation of said channels. The lower end 92 of the channel 85 is shown to terminate at the notional plane of intersection 16 and in the upper region of the vertical mullion 12. Water collected in channels 84 and 85 is then vectored therein, and carried downwardly and away as described in more detail below.

Referring back to FIG. 1, the assembly therein further illustrates the position of glass assembly 55 which includes glass panes 56, 57 and dead air space 58 therebetween. The rafter cap 62 and a vertical mullion cap 63 are shown to comprise the outer most surfaces of the assembly 10 with the underlying glazing rod 64 depicted thereon in engagement with the outer glass sheet 56. Spacers 60 are likewise shown at the intersecting regions of the glass panes of the vertical wall mullion 12 and angulated rafter 14. An eave cap 97, preferably formed of extruded aluminum is shown formed therein in a configuration adapted for an angular intersection of the respective hollow mullion members 12 and 14. A suitable caulking and sealing compound 98 is provided therearound with expandable gasket member 99 secured therein. Although the sealing members generally prevent outside water intrusion, some water because of human error will infiltrate at the rafter 14 to be collected in the channels 84 and 85, as discussed above. Water draining through the channels is ultimately deposited into the hollow region of the vertical mullion 12, as shown along the intersection line 92. The elastomeric sealant 32 provided between the spaced members 12 and 14 is left open along the end of the channels 84 and 85 to permit the passage of water and effective drainage therethrough. As described in more detail below, the water draining into the hollow mullion 12 is collected in a lower region and eliminated through a complemental drainage system.

Figure 3:
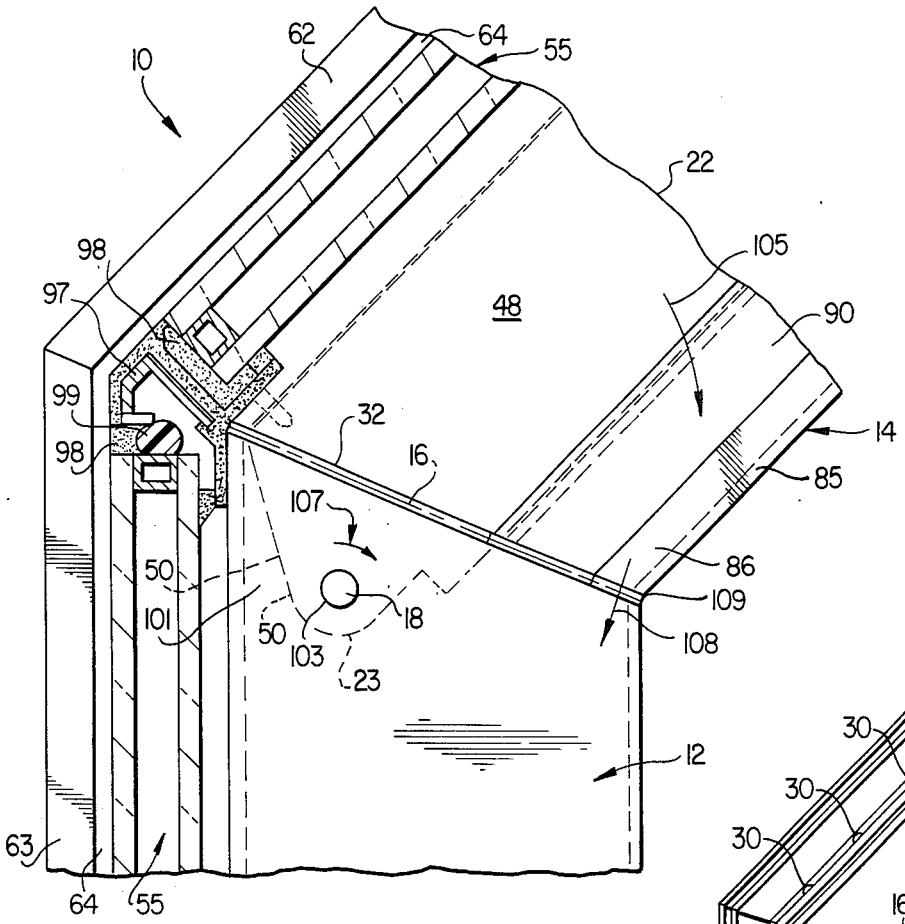
FIG. 3 is a side-elevational, cross-sectional view of an alternative embodiment of the flexible joint of FIG. 1 illustrating an exposed pin design.

Referring now to FIG. 3, there is shown an alternative embodiment of the dynamic eave assembly 10 of the present invention. The flexible pin joint is herein constructed with an exposed pin 18, but without the pivot arm 20 as shown in FIG. 1. The assembly 10 doss comprise rafter cap 62 secured against the glass assembly 55 by glazing rod 64. The vertical mullion 12 is likewise constructed for notional angular intersection. Upper rafter 14 thus includes drainage channel 85 formed therein by angulated wall section 90 and upstanding flange 86. The notional line of intersection 16 is shown to be filled with an elastomeric sealant 32 such as silicone or the like. Pin 18 is shown to extend through knee splice 22 in a manner similar to that shown in FIG. 1. The distal end 50 body section 48 is formed in an angulated relationship providing a space 101 between the end 50 and the frontal wall of the vertical mullion 12. An aperture 103 is formed in the vertical mullion 12 in position for receiving pin 18 therethrough and permitting the pivoting of the knee splice 22. In this manner, static and dynamic loading upon the rafter 14 which causes deflection in the direction of arrow 105 will produce some degree of pivoting (as indicated by arrow 107) about the pin 18. Pivotal movement 107 will result in some degree of closing at the inside joint region 109 (as indicated by arrow 108). With a sufficient gap provided along the notional plane of intersection 16, the movement 108 will not cause contact between the respective inside surfaces of the vertical mullion 12 and rafter 14 at point 109. A suitable gap is thus necessary for this dynamic eave configuration. Likewise, a suitable elasti material spacer 32 positioned in the notional plane of intersection 16 will allow the movement indicated by arrows 105, 107 and 108 without imparting stresses to the structural members 12 and 14. This can also be provided without interfering with the water passing through drainage channel 85. As discussed in more detail below, this drainage permits water to be eliminated from the rafter 14 into the wall region of the mullion 12 for elimination therebeneath.

Figure 4:
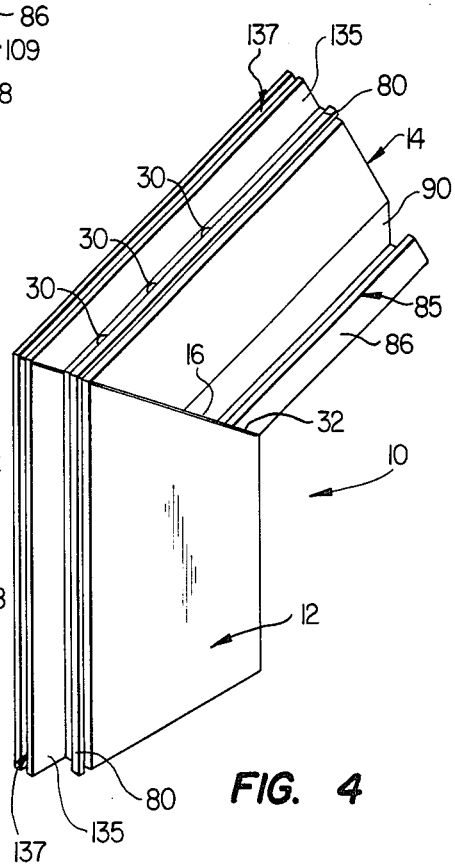
FIG. 4 is a fragmentary, perspective view of the flexible joint structural members of FIG. 1 illustrating the incorporation of drainage ears in a hollow mullion configuration of the type adapted for commercial building construction.

Referring now to FIG. 4, there is shown a fragmentary perspective view from a first angle of one embodiment of the structural members of the dynamic eave assembly 10 of the present invention. A section of upper rafter 14 is shown mitered and assembled to a mitered section of lower vertical mullion 12 with glazing rods, glass panes, clips, and eave caps removed for purposes of illustration. The notional plane of intersection 16 is shown with the sealant member 32 disposed therebetween. Drainage trough 85 is shown channeled therethrough. Flange member 86 is disposed outwardly of tapered wall 90 along rafter 14 to facilitate water collection into vertical mullion 12. Central fins 135 upstand from the frontal region of the rafter 14 and vertical mullion 12 to form an upstanding channel 137 therebetween. Channel 137 is adapted for receiving the clip 65 as shown in FIG. 2. Rafter cap 62 may then be secured thereto. The threaded fasteners 30 are also shown therein in engagement with an underlying knee splice 22, (not shown) in accordance with one embodiment of the present invention.

Figure 5:
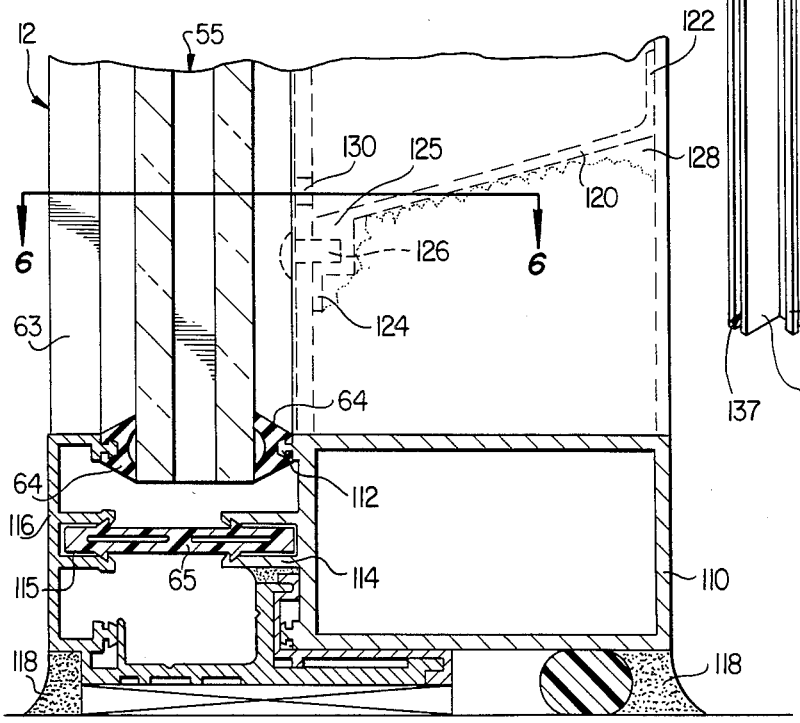
FIG. 5 is a side-elevational, cross-sectional view of one embodiment of a lower region of the mullion of FIG. 1 illustrating the system of the present invention facilitating drainage of water collected within the hollow mullion.

Referring now to FIG. 5 there is shown a side-elevational, cross-sectional view of one embodiment of a lower region of the vertical mullion 12 providing for water elimination. A water deflector plate 120 is thus angularly disposed therein. The assembly shown in FIG. 5 is comprised of a sill member 110 having a glazing rod engagement tine 112 extending outwardly therefrom in engagement with glazing rod 64. A sill fin 114 is likewise provided for coupling to elongate clip 65 adapted for engaging fin 115 formed in the outside wall 116 of the lower outside sill structure. Sealant 118, is provided outwardly and inwardly of the sill for conventional sealing. The water deflection member 120 provided inside the hollow mullion 12 then comprises an angular bulkhead. The bulkhead 120 includes an upstanding inside wall engagement member 122 and a depending outside wall engagement member 124. A securement block 125 is formed therein and adapted for receiving threaded fastener member 126 therethrough. In this manner, the water deflector 120 is secured within the mullion 12, providing an enormous storage volume thereabove for water intrusion occurring from leaks, condensate and the like. A suitable sealing compound 128, such as silicone or the like, is utilized in conjunction with the bulkhead 120 for affecting complete sealing therearound. A drainage aperture 130 is provided adjacent to the lower region of said deflection member for passing water outwardly. Water is therein caught above glazing rod 64 between the walls of the hollow mullion 12 and the glass assembly 55 and conventional drainage channels (not shown) are provided for drainage outwardly therefrom.

Figure 6:
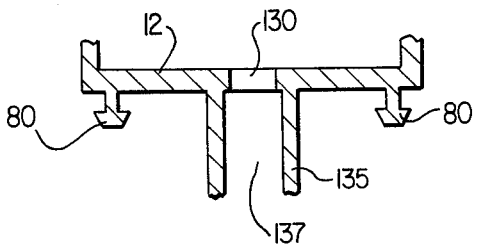
FIG. 6 is an enlarged, fragmentary, cross-sectional view of the vertical wall section taken along line 6—6 of FIG. 5.

Referring first to FIG. 6 there is shown an enlarged, top-plan, cross-sectional, fragmentary view of the vertical mullion 12 of FIG. 5 illustrating the drainage aperture 130 formed therethrough. Fins 135 of channel 137 are seen to upstand from adjacent sides of the aperture 130. It is important to note that the aperture 130 is positioned within the channel 137, whereby water egressing therefrom is allowed to migrate outwardly from the vertical mullion 12. For purposes of orientation gasket elements 80 are shown, said elements 80 being as adapted for engaging inside gaskets 82 (not shown). The drawing of FIG. 6 is, moreover, to be viewed in conjunction with the view of the aperture 130 of FIG. 5 in order to illustrate the manner in which drainage is provided from the drainage bulkhead 120 in accordance with one aspect of the present invention.

Figure 7:
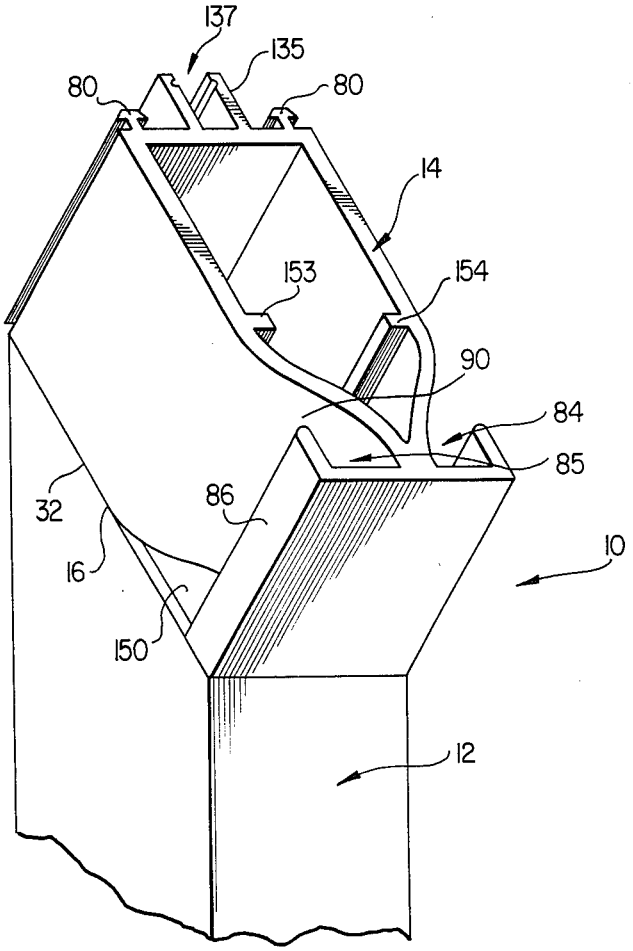
FIG. 7 is an enlarged, fragmentary, perspective view of an alternative angle of the flexible joint structure member of FIG. 4 illustrating more clearly the drainage ears thereof.

Referring now to FIG. 7, there is shown an enlarged perspective, fragmentary view of the flexible knee joint of the present invention in an alternative orientation to that shown in FIG. 4. The view of FIG. 7 more clearly illustrates the mitered intersection between the upper rafter 14 and vertical wall member 12 and the notional plane of intersection 16 therebetween. The particular structural elements 12 and 14 of this embodiment comprise the hollow mullions described above, which mullions very efficiently facilitate the water drainage aspect of the present invention. The intersection plane 16 further defines an open flow area 150 formed by the tapered wall section 90 of the rafter 14 adjacent the planar wall section of the vertical member 12. The open area 150 is in mating communication with the drainage channels 84 and 85 whereby water collected therein is vectored directly into the hollow region of the vertical mullion 12. Upper gasket elements 80 and the inside configuration of fins 135 are also shown in this view. This configuration should be viewed in conjunction with the fin construction shown in FIG. 2 adapted for engaging the internal pin assembly 65. Inside structural flanges 153 and 154 are likewise shown projecting inwardly within the hollow mullion region of rafter 14, which configuration comprises but one embodiment of a construction of the hollow mullion 14.

The present invention teaches a dynamic eave assembly comprising a flexible joint configuration. It should be noted that the invention is not limited to hollow mullion configurations. I-beam structures and the like may be utilized. Such assemblies could include side wall members which engage the oppositely disposed top and bottom sections of the I-beam in generally parallel spaced relationship relative to the central web portion of the I-beam. This particular configuration is not shown due to the fact that I-beam construction is conventional in the prior art and the teachings of the present invention are enabling for such a dynamic eave. Likewise, solid structure members including wooden beams can likewise be adapted with flexible joint members as herein defined for facilitating the dynamic eave configuration and the myriad of advantages thereof. The utilization of the hollow mullion in the drawings of FIGS. 1–7 are, however, helpful in illustrating one method of coupling a pivotal member such as knee splice 22. Likewise the hollow mullion configuration facilitates various drainage aspects and the formation of the drainage channels 84 and 85. It should be seen that the utilization of various glass sealing and glazing elements, eave and rafter caps, securement assemblies (such as pin assembly 65), and related structural elements currently utilized in contemporary curtain wall design may be modified in various ways to accommodate the structure of the present invention. When using the hollow mullion configuration set forth above, the incorporation of the knee splice 22, having the curved nose portion 23 described above, greatly facilitates the use of a single knee splice assembly for a variety of angles of structural joint intersections. The rafter 14 and vertical member 12 can therein be constructed for a variety of angular relationships which are accommodated by a single structural design of the knee splice 22 and lower pivot arm 20. In essence, angular variations are accommodated by altering the hole pattern of fasteners 26 and 30 to shift the position of the pivot arm journal 40 and knee splice 22.

As set forth above, the dynamic eave 10 of the present invention affords structural interengagement facilitating static and dynamic loading without the inherent stresses and structural degeneration conventional in hollow mullion eave assemblies. The present invention provides structural integriy and water elimination without utilization of exposed welds, gusset plates, rivets and the like. The dynamic eave 10 may be constructed with an exposed pin 18 as shown in FIG. 3 or with the hidden pin 18 shown in FIGS. 1 and 2. It should also be noted that the pin configuration is but one structural embodiment and a plurality of other pivotal approaches may be utilized. The present invention also lends itself to improved drainage and during periods of high wind or rain, water intrusion problems can be substantially eliminated along with the associated "loading" problems from a structural standpoint. It may further be seen that various angular intersections can be provided between the vertical mullion 12 and rafter 14. These angular differences are accommodated by variations in the knee splice 22 and the assembled in conjunction therewith.

It is thus believed that the operation and construction of the present invention will be apparent from the foregoing description. While the method and apparatus shown and described has been characterized as being preferred, it will be obvious that various changes and modifications may be made therein without departing from the spirit and scope of the invention as defined in the following claims.

What is claimed is:

1. An improved structural joint for the mitered intersection between vertical and angulated structural members of the type wherein said angulated member is secured to said vertical member across a mitered intersection defining a notional plane of intersection therebetween, said improvement comprising means securing said angulated member to said vertical member permitting pivotal movement therebewteen, means for maintaining a spaced relationship across said notional plane of intersection between said vertical and anuglated members for allowing flexibility and relative movement therebetween and where in said vertical and angulated structural members each comprise a mullion adapted for the securement of glass panes thereto and intersecting one another in angulated relationship across said notional plane defined therebetween.

2. The structural joint as set forth in claim 1 wherein said vertical mullion further includes a pivot arm secured therein having a journal formed therethrough and adapted for receipt of said pin therein, said second mullion having a knee splice secured therein, said knee splice having apertures formed through the side walls thereof adapted for receiving said pin therethrough for facilitating pivotal motion about said journal.

3. The structural joint as set forth in claim 2 wherein said knee splice comprises a hollow channel having oppositely disposed apertures formed therethrough in axial alignment with said journal received therein and means for securing said knee splice to said second mullion for securement thereto.

4. The structural joint as set forth in claim 2 wherein said knee splice is further constructed with an angular end face adapted for receipt in and positioned adjacent the inside of said first hollow mullion, said end face constructed at an angle permitting the pivotal movement of said second hollow mullion about said pin across said space along said notional plane of intersection.

5. The structural joint as set forth in claim 1 wherein said means coupling said first and second mullions further includes first and second apertures formed in one of said mullions and a knee splice adapted for mounting in the other of said hollow mullions, said knee splice having first and second apertures formed therein and adapted for registration with said apertures of one of said mullions for the receipt of said pin therethrough and the pivotal action of said mullions therearound.

6. The structural joint as set forth in claim 5 wherein said apertures are formed in said first, vertical mullion and said knee splice is secured in said second hollow mullion with a plurality of fastener members extending therethrough facilitating secured structural engagement between said second hollow mullion and said knee splice and said pivotal motion about said pin.

7. The structural joint as set forth in claim 1 wherein said second hollow mullion is constructed with at least one drainage channel formed outwardly therealong, said drainage channel terminating along said notional plane of intersection between said first and second mullions and adapted for discharging water therefrom into the hollow region of said first mullion.

8. The structural joint as set forth in claim 7 and further including a slanted bulkhead disposed in a lower region of said first hollow mullion adapted for sealably retaining water thereabove received from said second hollow mullion and means disposed adjacent said bulkhead means for discharging said water received therein.

9. A dynamic eave assembly for coupling structural members in an angulated relationship one to the other and allowing flexibility therebetween for dynamic and static loading thereupon, said structure comprising means associated with said angulated members facilitating pivotal interaction therebetween, means for establishing a notional plane of intersection between said angulated members and a predefined space therebetween to accommodate said pivotal action during dynamic loading across said eave said means coupling said structural members comprising a pivot pin secured to one of said members and means associated with the other said members for engaging said pin and affording pivotal movement therearound, said structural members comprising a pivot, a first vertical mullion and a second mullion disposed at an angle relative thereto, said vertical mullion further including a pivot arm secured thereto having a journal formed therethrough and adapted for receipt of said pin therein, said second mullion having a knee splice secured thereto, said knee splice having apertures formed through the side walls thereof adapted for receiving said pin therethrough for facilitating pivotal motion about said journal, and said mullions each being hollow and further including means disposed in a lower region of said first hollow mullion adapted for sealably retaining water thereabove received from said second hollow mullion and means disposed adjacent said sealing means for discharging said water received therein.

10. The dynamic eave as set forth in claim 9 and further including an elastomeric member disposed along said notional plane of intersection between said angulated members for filling said predefined space therebetween and accommodating relative movement therealong.

11. A flexible structural joint comprising:

a first mullion adapted for generally vertical positioning in the construction of a wall;

a second mullion adapted for generally angulated positioning relative to said first mullion, said first and second mullions intersecting one another in an angulated relationship across a notional plane defined therebetween; means coupling said first and second mullions one to the other pivotal relationship therebetween;

means for defining and maintaining a space along said notional plane of intersection between said first and second mullions to facilitate relative movement therebetween and flexibility of said mullions one to the other;

said means coupling said first and second mullions comprising a pivot pin secured in one of said mullions and means associated with the other of said mullions for engaging said pin and affording pivotal movement therearound, and one of said mullions including a pivot arm secured thereto having a journal formed therethrough and adapted for receipt of said pin therein, said second mullion including a knee splice secured thereto, said knee splice having aligned apertures formed through the side walls thereof adapted for receiving said pin therethrough and facilitating pivotal motion about said journal.

12. The structural joint as set forth in claim 11, wherein said knee splice comprises a hollow channel having oppositely disposed apertures formed therethrough in axial alignment with said journal received therebetween and means for mounting said knee splice to said second mullion for securement thereto.

13. The structural joint as set forth in claim 11 wherein said knee splice is further constructed with an angular end face adapted for receipt in and positioned adjacent an inside surface said first hollow mullion, said end face being constructed at an angle permitting the pivotal movement of said second hollow mullion about said pin across said space along said notional plane of intersection.

14. The structural joint as set forth in claim 11 wherein said means coupling said first and second mullions further includes first and second apertures formed in said vertical mullion and a knee splice adapted for receipt in said second hollow mullion, said knee splice having first and second apertures formed therein and adapted for registration with said apertures of said vertical mullion for the receipt of said pin therethrough and the pivotal action of said mullions, therearound.

15. The structural joint as set forth in claim 14 wherein said knee splice is secured in said second hollow mullion with a plurality of fastener members extending therethrough facilitating secured structural engagement between said second hollow mullion and said knee splice and said pivotal motion about said pin.

* * * * *